United States Patent [19]

Greeson

[11] Patent Number: 4,768,938

[45] Date of Patent: Sep. 6, 1988

[54] APPARATUS FOR POURING CONCRETE SLABS

[76] Inventor: Logan C. Greeson, 1286 Marine Dr., West Palm Beach, Fla. 33409

[21] Appl. No.: 99,070

[22] Filed: Sep. 21, 1987

[51] Int. Cl.[4] ..... E04G 11/38

[52] U.S. Cl. ..... 425/62; 249/19; 249/23; 249/211; 264/33; 280/47.16; 425/65

[58] Field of Search ..... 249/13, 18, 19, 20, 249/23–25, 28, 29, 31, 189, 211; 425/62, 63, 65; 264/33, 34; 280/47.16; 294/81.1, 81.3; 414/10, 11; 254/4 R, 4 C

[56] References Cited

U.S. PATENT DOCUMENTS

| | | | |
|---|---|---|---|
| 1,113,317 | 10/1914 | Dziemian | 249/25 |
| 1,537,882 | 5/1925 | Roberts | 249/28 |
| 1,571,763 | 2/1926 | Edmonds | 249/50 |
| 2,916,795 | 12/1959 | Henderson | 249/50 |
| 3,037,259 | 6/1962 | Dave | 425/62 |
| 3,168,771 | 2/1965 | Nelson | 249/50 |
| 3,618,889 | 11/1971 | Lipski | 249/50 |
| 3,674,232 | 7/1972 | Varlonga | 249/33 |
| 3,744,945 | 7/1973 | Metrailer | 249/27 |
| 3,770,857 | 11/1973 | Haws | 264/33 |
| 3,813,076 | 5/1974 | Draughon et al. | 249/50 |
| 3,845,930 | 11/1974 | Metrailer | 249/50 |
| 3,966,164 | 6/1976 | Dashew | 249/18 |
| 3,977,536 | 8/1976 | Moore et al. | 249/18 |
| 3,993,720 | 11/1976 | Burdett | 264/33 |
| 4,040,594 | 8/1977 | Maier | 249/27 |
| 4,227,672 | 10/1980 | Cunningham | 249/28 |
| 4,231,977 | 11/1980 | Schreck et al. | 264/33 |
| 4,462,951 | 7/1984 | Martin | 264/334 |
| 4,492,358 | 1/1985 | Manderla | 249/18 |
| 4,585,204 | 4/1986 | Parker et al. | 249/28 |

FOREIGN PATENT DOCUMENTS

| | | | |
|---|---|---|---|
| 77300 | 7/1919 | Austria | 249/23 |
| 3971 | 6/1891 | Switzerland | 249/24 |

*Primary Examiner*—Jay H. Woo
*Assistant Examiner*—James C. Housel
*Attorney, Agent, or Firm*—Victor F. Volk

[57] ABSTRACT

To pour and set concrete slabs the form deck is chained to a light truck and the combination is supported between joists. The truck can be lowered while the slab is curing, and raised again before the combination is again lowered to be "flown" to another location.

7 Claims, 3 Drawing Sheets

APPARATUS FOR POURING CONCRETE SLABS

BACKGROUND OF THE INVENTION

This invention relates to a method of constructing concrete buildings and particularly multistoried concrete buildings. The slabs of such buildings are poured into deck forms for setting and it is a purpose of the present method and novel apparatus associated therewith to simplify and economize the operations of moving and installing these forms. To place and hold the forms in position it has been known to use a plurality of mechanical or hydraulic jacks, fixed or mobile. For a large deck, a plurality of such jacks are required, introducing the need for expensive manpower for their manipulation. Other problems that have been encountered in the repeated reuse of slab deck forms has been that it has often been difficult to make an exact fit of a form one location into another, even though the new location may be an upper storey of the same bay. It is also often difficult to drop the deck from the hardened concrete since it is relatively light and will not always fall from its own weight. Flying the deck to another position has presented the problem of cantilevering it from one storey while the crane cable is being attached. These problems are solved and prior methods are greatly simplified by the method to be explained.

It has further been known to support long, narrow form decks on relatively closely spaced prestressed concrete joists, but such decks have not been reusable and are knocked apart after each slab formation.

SUMMARY OF THE INVENTION

My method of constructing a plurality of concrete building slabs comprises the steps of aligning spaced-apart beams, such as pre-stressed reinforced concrete joists, for supporting one of said slabs; affixing temporary means, borne by these beams, for supporting a combined truck and concrete-form deck; and then lowering the combined truck and deck down upon the temporary support means. Thereafter I affix tensile reinforcing members on the deck and pour a slab onto the deck and reinforcing members. I construct a central opening through the slab, affix a cable to the truck through this opening and lower the truck and the deck to a floor beneath the slab, by means of the cable. Thereafter I move the truck with the deck to an edge of the slab, attach a cable to the truck through a central opening in the deck, and, after aligning spaced-apart beams at a second location and affixing temporary support means borne by said beams, raise the truck and deck by means of the cable and lower them onto the temporary supports.

Prior to affixing the reinforcing members on the deck I may, advantageously, release the the truck from the deck and lower it to a floor beneath the deck by means of a cable through a central opening in the deck and prior to lowering the combined truck and deck I may have to lift the truck, by means of the cable, to a position directly beneath the deck and attach the truck to the deck. This lifting may, advantageously, be done by means of a winch that is supported on the newly set slab.

Advantageously, the temporary support means comprise horizontal members inserted into holes in the beams and the truck is held to the deck by a plurality of parallel chain-like members.

For use in my method I have invented a form deck for pouring concrete slabs that comprises a flat surface of horizontal members, a plurality of supporting beams attached edgewise to said horizontal members, and a plurality of chain-like members, distributed along the length of said deck and suspended from it. Advantageously, either or both of the aforesaid horizontal members and/or supporting beams may comprise wood.

For use also in my method I have invented a truck comprising a pair of beams for supporting the deck with wheel means, or other support means, at both ends. My truck also has centrally positioned wheel means extending lower than the end wheel or other support means to create a rocker or teeter-totter effect.

My truck also comprises tubular post means that is rigidly affixed to the truck at its center of gravity and projects upwardly from it, and connecting means passing through the post means to connect the truck to an overhead cable so that the truck and any deck that it carries can be hoisted from floor to floor of a building under construction. In one embodiment, pairs of chain-like members are fastened to the beams of the truck for binding it to the deck.

DETAILED DESCRIPTION OF PREFERRED EMBODIMENT

Figure 1A:
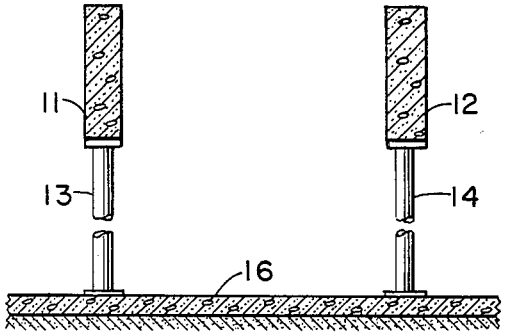
FIG. 1*a* shows a sectionalized elevation of the ends of two joists in place on temporary shoring.
Figure 1D:
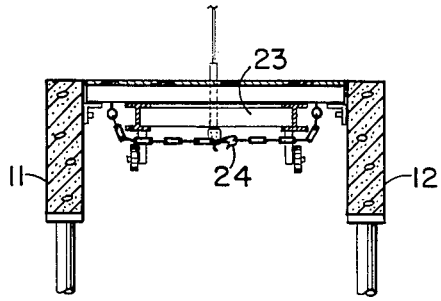
FIG. 1*d* shows an elevation of the upper portion of the joist sections of FIG. 1*a* with the deck supported on the angle supports.
Figure 1B:
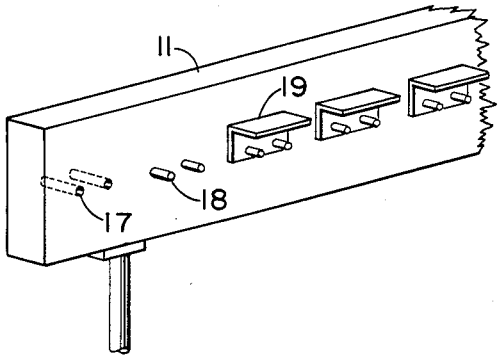
FIG. 1*b* shows an enlarged perspective of the top portion of one of the joists of FIG. 1*a* with angle supports mounted thereon.
Figure 1E:
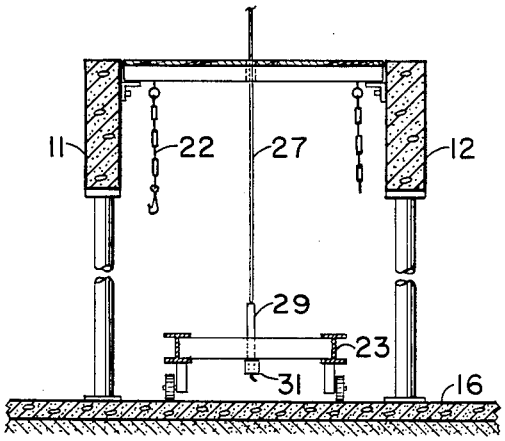
FIG. 1*e* shows the elevation of FIG. 1*a* with the truck lowered to ground.
Figure 1C:
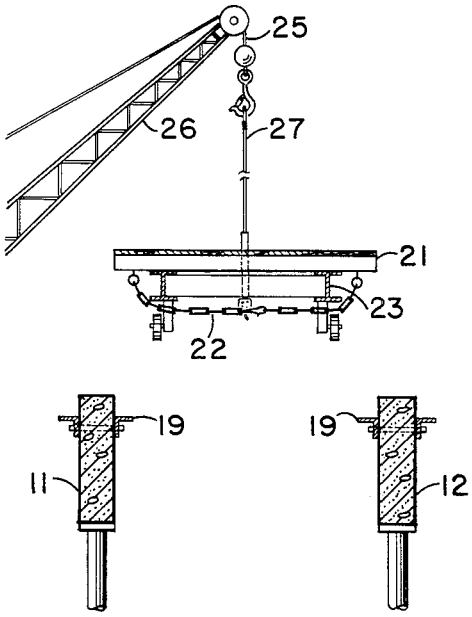
FIG. 1*c* shows an end view of the joist sections of FIG. 1*a* with a form deck and truck being lowered by a crane.
Figure 1F:
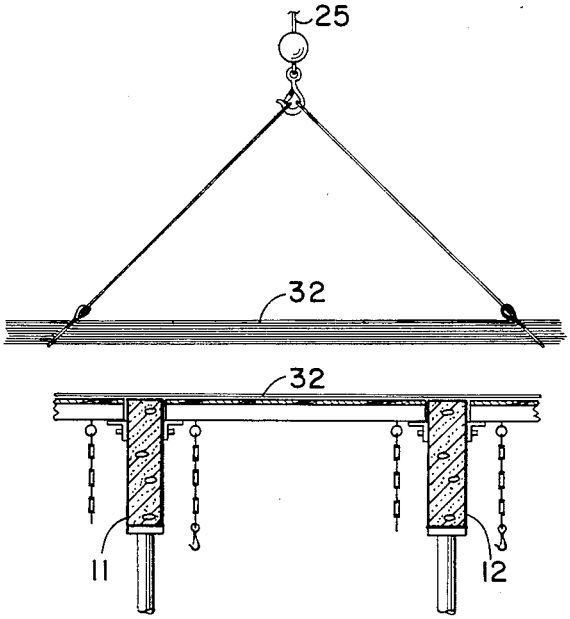
FIG. 1*f* shows an elevation of the joist sections of FIG. 1*a* with reinforcing rods being lowered to the decks.
Figure 1G:
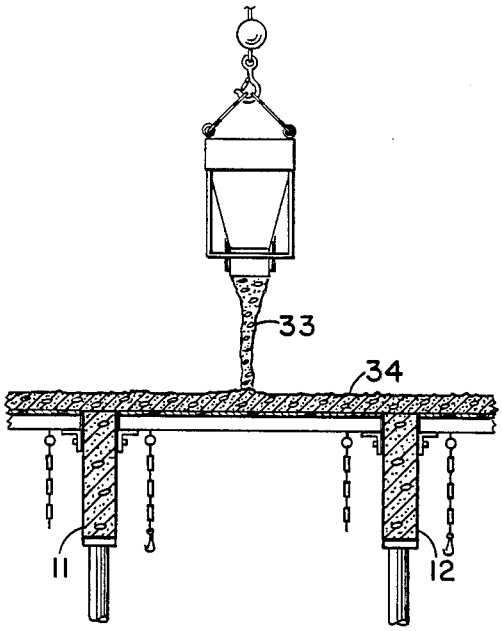
FIG. 1*g* shows the elevation of FIG. 1*f* with concrete being poured onto the decks.
Figure 1J:
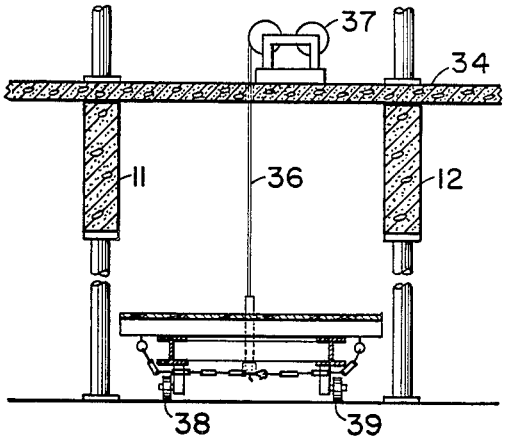
FIG. 1*j* shows the elevation of FIG. 1*h* with the truck and deck lowered to ground.
Figure 1H:
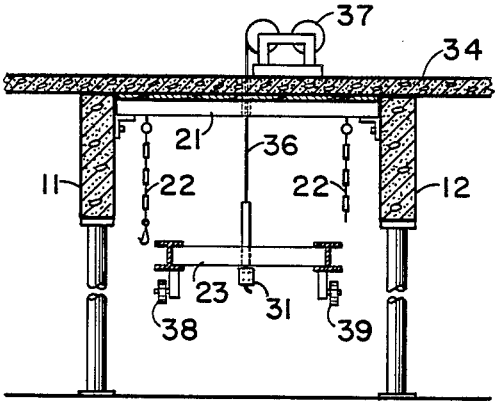
FIG. 1*h* shows the elevation of FIG. 1*a* with a hoist in place and the truck being raised.
Figure 1I:
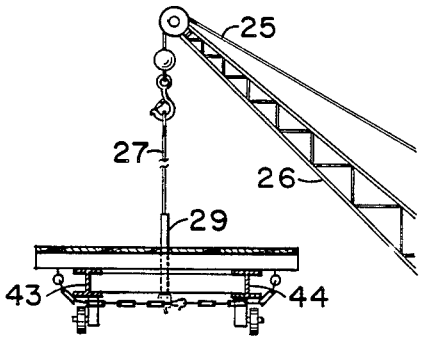
FIG. 1*i* shows an upper portion of the elevation of FIG. 1*h* with the truck chained to the deck.
Figure 1I:
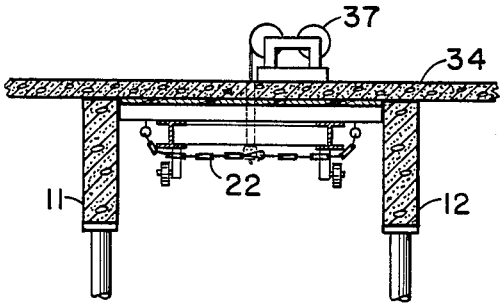

Two of a row of prestressed concrete joists 11, 12 are shown in FIG. 1*a* temporarily mounted on shoring columns 13, 14 that are supported on the ground 16 of a building the first floor of which is under construction. These joists and the other similar prestressed joists on this and upper floors are not merely temporary adjuncts to the construction process but become permanent structural elements of the completed building. At this point the joists which may typically be 12 or 16 inches (30.5 or 40.6 cm) in depth and 6 inches (15 cm) wide at the top with a slight downward taper, and up to about 60 feet (18.3 m) long can be readily shifted in position to accommodate minor variations in the building dimensions. As shown in FIG. 1*b*, for the joist 12, the joists are perforated by pairs of lateral holes 17 through which a plurality of rods 18 can be thrust to support perforated angle plates 19, forming, in affect, shelves for the support of a form deck 21, which is seen in FIG. 1*c* being lowered onto the shelves 19 while chained by a plurality (see FIG. 2) of pairs 22 of chains to a light truck 23. The angles 19 are so positioned that the top of the deck 21 will be flush with the tops of the joists 11, 12 and strips of wood (not shown) can be interposed as shims, where necessary, to affect minor adjustment for this purpose. Once the deck is in place (FIG. 1*d*) a snap hook 24 on each of a plurality of six pairs of the chains 22 distributed lengthwise of the deck 21 is released while the truck 23 is still supported by a crane 26 by means of a cable length 27 which, in turn, is hooked to a crane cable 25. The cable 27 has been passed through an opening 28 (FIG. 3) in the deck, and a pipe length 29 welded at the center of gravity of the truck 23 to be secured by a cable stop 31. The truck 23 is then lowered to the floor 16, leaving the deck 21 in place, supported by the joists 11, 12. The cable is released from the cable stop 31, freeing the crane for other jobs, such as the transport of reinforcing bars 32 which are laid across the deck 21 and similar decks which have been positioned parallel to it on the same floor level. Concrete 33 (FIG. 1*g*) is then poured over the extended surface formed by the tops of the joists and the parallel decks to form a slab 34 which is permitted to set. After the concrete has set the truck 23 is raised by means of another cable 36 and hoist 37 to again be attached by means of the chains 22 to the deck 21. For this purpose the hoist 37 is supported on the newly set slab 34 and the cable is passed through a small (1 inch) opening in the slab 34.

Figure 1K:
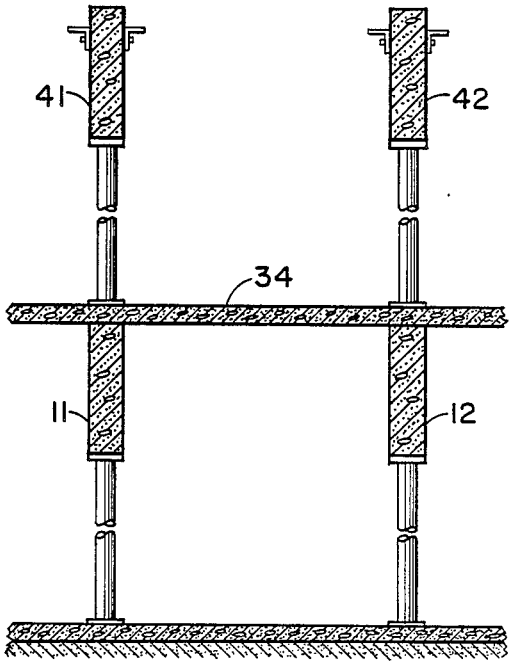
FIG. 1*k* shows an elevation of the joist sections of FIG. 1*a* surmounted by second floor joists with a deck and truck being lowered by a crane.

The rods 18 and angles 19 are removed while the truck is still supported by the cable 36 and the truck and deck are lowered by the hoist 37 to the floor 16. Although the slight taper, aforementioned, in the joists aids to release the form 21 from the hardened concrete without disintegrating, the added weight of the chains and the truck assure that it will lower evenly to the floor. Here the cable 36 is released, the truck and deck are rolled on wheels 38, 39, which are positioned mid-length of the truck (FIG. 5) to a position where the cable length 27, or another short cable that can be hooked onto the cable 25, can be attached to the cable stop 31, and the combined deck and truck are lifted free. New joists 41, 42 having meanwhile been prepared (FIG. 1*k*) with support angles as before, the deck and truck are lowered on the second floor to repeat the foregoing steps. This can be repeated storey after storey, using the same deck. Whereas, in actual present construction practice, the decks are knocked apart after each pouring has set.

Figure 2:
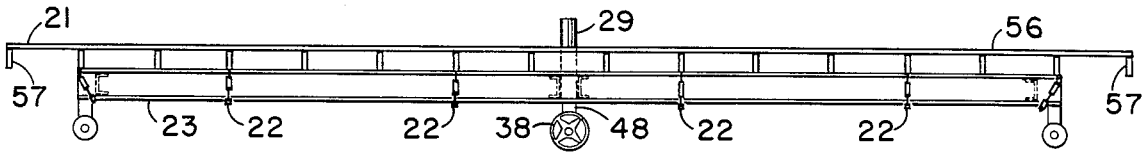
FIG. 2 shows a side view of a truck with a form deck chained thereto.
Figure 3:
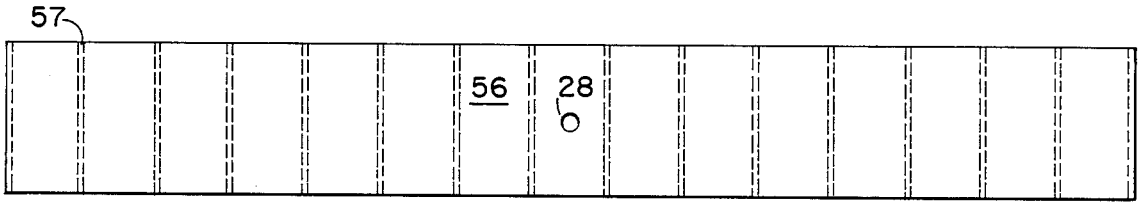
FIG. 3 shows a plan of the deck of FIG. 2.
Figure 4:
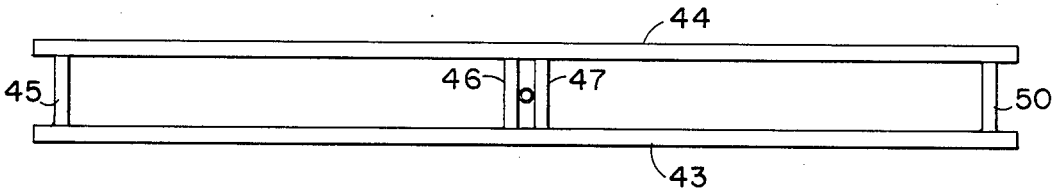
FIG. 4 shows a plan of the truck of FIG. 2.
Figure 5:
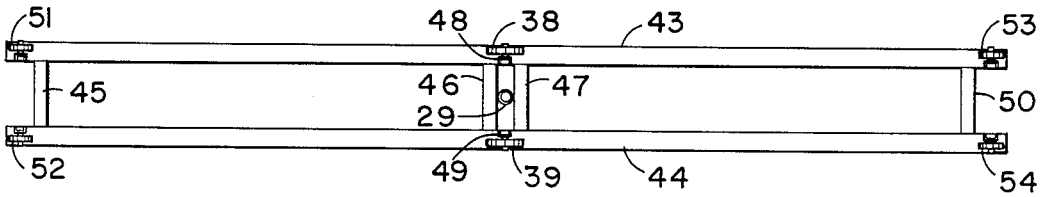
FIG. 5 shows a bottom view of the truck of FIG. 4.

The truck 23 is shown in detail in FIGS. 2, 4, and 5. It comprises, essentially, 2 parallel I-beams 43, 44 held together by central cross members 46, 47 comprising channels or angles welded to the I-beams. Welded between these cross members, the pipe-length 29 provides a fulcrum point to keep the truck substantially horizontal when it is "flying" and it should be understood that additional points and guide lines can be provided in a known manner where required. In a typical case the truck 23 is 50 feet (15.2 m) long and about 3 feet (1 m) wide. The I-beams are also connected across their ends by welded members 45, 50 and the wheels 38, 39 are mounted on respective channels 48, 49. The length of the channels 48, 49 are such that the wheels 38, 39 extend further down than end wheels 51, 52, 53, 54 which are similarly mounted on the I-beams 43, 44. This makes it easy to maneuver the light-weight truck on the two central wheels, and, in fact, the wheels 51–54 may be replaced by studs that act merely as rests.

Figure 6:
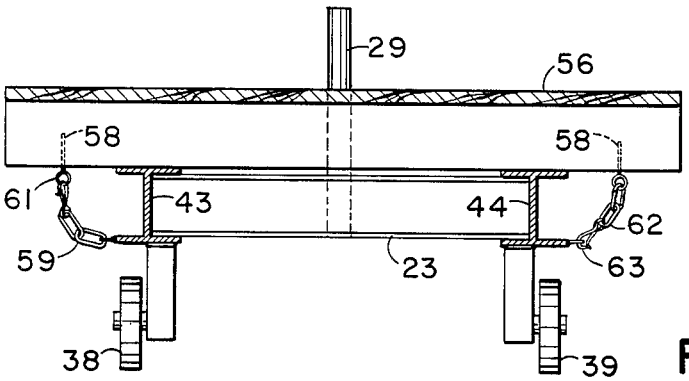
FIG. 6 shows a section through another embodiment of my truck and form deck combination.

The deck form 21, as seen in FIG. 2 comprises a smooth top surface member 56 of $\frac{3}{4}$-inch plywood reinforced by wooden 2×4 inch beams 57 with the opening 28 for the pipe 29 already described. To hold the pairs of chain 22 heavy screw-eyes 58 or similar known devices are screwed into a plurality of the beams 57 at points set in far enough not to interfere with the angles 19. In FIGS. 1*a*–1*k* the chain pairs 22 have been shown long enough to connect beneath the truck 23. But, in the embodiment illustrated in FIG. 6 a shorter chain 59 is shown, attached to a flange of the I-beam 43, and connecting to one of the screw eyes 58 in the deck by means of a snap hook 61 of which a number of types are commercially available. This leaves the chains themselves permanently connected to the truck. Alternatively, I have shown a short chain 62 which is permanently attached to one of the eye screws 58 and connects to the beam 44 by means of a snap hook 63.

As a practical example of the application of my novel method on a typical construction job fifty trucks 23 and decks 21 might be built to enable each of the decks to be reused as many as 50 times in different locations without being dismantled. This economy in man hours saved from tearing down and reconstructing form decks may easily result in a 50% saving in construction time.

The foregoing description has been exemplary rather than definitive of my invention for which an award of Letters Patent is desired as defined in the appended claims.

I claim:

1. An apparatus for constructing concrete building slabs comprising the combination of:

a concrete form deck for forming a concrete slab releasably attached to said deck for supporting and transporting said deck, said form deck comprising:

a form member having an upper flat forming surface and an oppositely directed bottom surface, with a central opening extending between said surfaces, and a plurality of spaced supporting beams attached to said bottom surface of said form member, and a truck comprising:

a pair of spaced apart parallel beams connected by transverse end members for supporting said deck, wheel means attached to said parallel beams for transport of said truck along a surface, tubular post means rigidly affixed to said truck at a center of gravity thereof, said post means projecting upwardly from said truck, and means for releasably connecting the truck to an overhead cable passing through said post means and said central opening in said deck, said apparatus further comprising a plurality of elongate flexible securing means spaced along said deck and said truck for releasably connecting said deck and said truck together.

2. The apparatus of claim 1 wherein said truck further comprises end support means at both ends of said truck, said wheel means being centrally positioned on said truck, said centrally positioned wheel means being lowered than said end support means thereby creating a rocker effect.

3. The apparatus of claim 2 wherein said end support means comprise wheels.

4. The apparatus of claim 1 wherein at least one of said form member and said beams comprise wood.

5. The apparatus of claim 1 wherein said elongate flexible securing means are suspended from opposite ends of said deck beams and are sufficiently long to enclose said truck beneath said deck, and comprise means to releasably connect ends of said elongate flexible securing means together.

6. The apparatus of claim 1 wherein said elongate flexible securing means are fixedly secured to the truck beams in pairs.

7. The apparatus of claim 1 wherein said elongate flexible securing means comprise chain members.

* * * * *